US006261192B1

(12) United States Patent
Otani

(10) Patent No.: US 6,261,192 B1
(45) Date of Patent: Jul. 17, 2001

(54) TENSIONED, LOCALLY HARDENED AND WEIGHTED GOLF CLUB HEAD FACE PLATE

(76) Inventor: Tony U. Otani, 12438 Eckleson St., Cerritos, CA (US) 90703

( * ) Notice: Subject to any disclaimer, the term of this patent is extended or adjusted under 35 U.S.C. 154(b) by 0 days.

(21) Appl. No.: 09/362,206

(22) Filed: Jul. 28, 1999

(51) Int. Cl.[7] ..... A63B 53/04

(52) U.S. Cl. ..... 473/324; 473/329; 473/342; 473/345; 473/409

(58) Field of Search ..... 473/324, 342, 473/345, 334, 335, 336, 337, 338, 339, 349, 350, 329, 409, 131, 290, 291

(56) References Cited

U.S. PATENT DOCUMENTS

| | | | |
|---|---|---|---|
| 690,940 | | 1/1902 | Febiger . |
| 1,494,494 | * | 5/1924 | Lippincott . |
| 1,595,589 | * | 8/1926 | Tyler . |
| 1,646,461 | * | 10/1927 | Relle . |
| 1,654,257 | * | 12/1927 | Hillerich . |
| 1,704,119 | * | 3/1929 | Buhrke . |
| 1,825,244 | | 9/1931 | Nero . |
| 1,840,451 | * | 1/1932 | Jansky . |
| 1,894,841 | | 1/1933 | Adams . |
| 2,124,534 | | 7/1938 | Barnhart . |
| 2,592,013 | | 4/1952 | Curley . |
| 3,387,844 | | 6/1968 | Shippee . |
| 3,516,673 | | 6/1970 | Estes . |
| 3,589,731 | | 6/1971 | Chancellor, Jr. . |
| 3,730,529 | * | 5/1973 | Donofrio . |
| 3,817,522 | | 6/1974 | Simmons . |
| 3,993,314 | | 11/1976 | Harrington et al. . |
| 4,021,047 | | 5/1977 | Mader . |
| 4,156,526 | | 5/1979 | Huggins et al. . |
| 4,461,481 | | 7/1984 | Kim . |
| 4,655,458 | | 4/1987 | Lewandowski . |
| 4,934,703 | * | 6/1990 | Delaney . |
| 5,046,740 | | 9/1991 | D'Eath . |
| 5,064,197 | | 11/1991 | Eddy . |
| 5,178,392 | | 1/1993 | Santioni . |
| 5,263,713 | | 11/1993 | Taylor et al. . |
| 5,328,175 | | 7/1994 | Yamada . |
| 5,346,216 | | 9/1994 | Aizawa . |
| 5,366,222 | | 11/1994 | Lee . |
| 5,410,798 | | 5/1995 | Lo . |
| 5,522,594 | | 6/1996 | Taylor et al. . |
| 5,564,705 | * | 10/1996 | Kobayashi . |
| 5,632,693 | | 5/1997 | Painter . |
| 5,672,116 | | 9/1997 | Bryan et al. . |
| 5,779,558 | | 7/1998 | Britton . |
| 5,807,190 | * | 9/1998 | Krumme . |
| 5,816,927 | | 10/1998 | Taylor . |
| 6,007,435 | * | 12/1999 | Chern . |

FOREIGN PATENT DOCUMENTS 24274 of 1899 (GB) .

* cited by examiner

*Primary Examiner*—Sebastiano Passaniti
(74) *Attorney, Agent, or Firm*—Peter D. Keefe

(57) ABSTRACT

A golf club head having a face plate that is tensioned, locally hardened and weighted at the impact zone by the presence of at least one hardened, dense metal plug to thereby provide enhanced distance and directional stability to a struck golf ball. The face plate has one or more metal plugs tensionally interfitted therewith, wherein the face plate is caused to be tensioned and locally hardened by the presence of the one or more metal plugs. The one or more metal plugs are located at the impact zone of the face plate where the golf ball is struck.

3 Claims, 4 Drawing Sheets

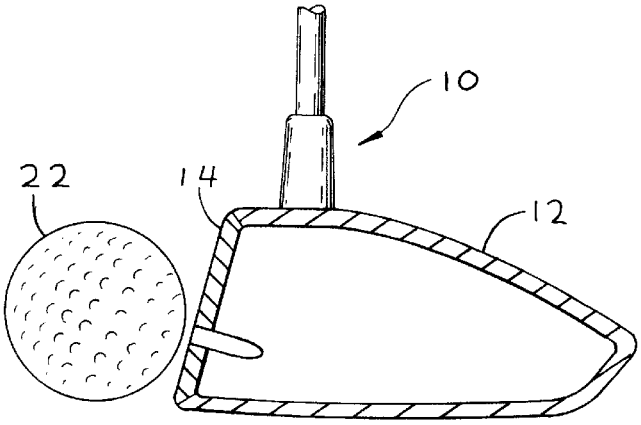
FIG. 2
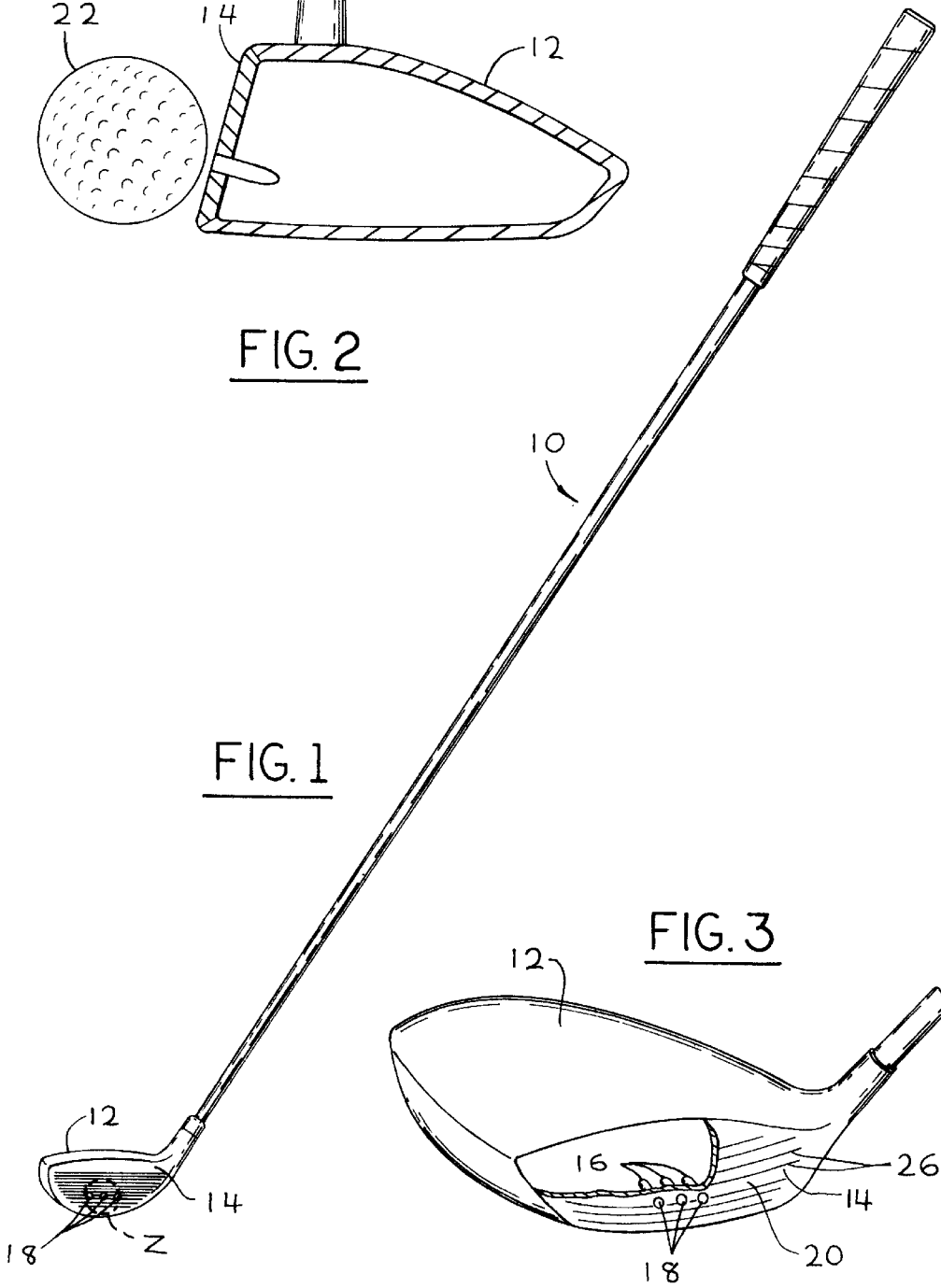
FIG. 1
FIG. 3

TENSIONED, LOCALLY HARDENED AND WEIGHTED GOLF CLUB HEAD FACE PLATE

BACKGROUND OF THE INVENTION

1. Field of the Invention

The present invention relates to golf clubs, and more particularly to the face plate of the club head thereof. More particularly still, the present invention relates to a face plate which is tensioned, locally hardened and weighted at the impact zone.

2. Description of the Prior Art

Golf is a game of skill having two mutually indispensable factors: the talent of the player and the quality of the player's golf clubs. One of the areas of concern for manufacturers of golf clubs is the interaction between a golf ball and the face plate of the golf club head. It is well known that an alloy for the face plate should exhibit the dual qualities of high tensile strength and high hardness in order for the golf club head to transfer a maximum of kinetic energy to the golf ball.

However, no matter what alloy may be chosen for the face plate, there are inherent limits to hardness and tensile strength, as for example due to unsuitability for welding to the head structure. Further aspects of transfer of kinetic energy between a golf ball and a golf club, which are not addressed merely by alloy selection, are face plate tensioning and concentration of mass at the impact zone, both of which can have a profound affect on how far a golf ball can be driven and how accurately it travels.

Accordingly, what remains needed in the golf club art is a golf club featuring a club head, wherein the face plate thereof is tensioned and weighted at the impact zone.

SUMMARY OF THE INVENTION

The present invention is a golf club head having a face plate that is tensioned, locally hardened and weighted at the impact zone to thereby provide enhanced distance and directional stability to a struck golf ball.

The face plate according to the present invention has one or more hardened metal plugs tensionally interfitted therewith, wherein the face plate is caused to be locally hardened and tensioned by the presence of the one or more metal plugs. The one or more metal plugs are located at the impact zone of the face plate where the golf ball is struck.

The preferred metal plug is a high density, hardened metal, such as f or example tungsten carbide or other metal carbides or hardened alloy steels. Each metal plug has a diameter on the order of the face plate groove width, ie., about 2.5 millimeters to about 3.5 millimeters, and having a length of about 10 millimeters to about 30 millimeters.

According to a preferred method of fabrication, a face plate is drilled to provide a hole for each metal plug, wherein each hole is at a predetermined location of the impact zone, and wherein each hole has a diameter less than the diameter of the metals plugs by about 0.02 millimeters to about 0.03 millimeters. Each metal plug is press fit into its respective hole, whereupon each metal plug causes the face plate to became tensioned owing to the fact it has a larger diameter than the diameter of the hole into which it is received. Each metal plug is oriented perpendicular to the face plate and the exposed face thereof is aligned flush with the adjacent surface of the face plate. An alternative method of fabrication is to insert cast the metal plugs with the face plate, wherein solidification generates a tensioning effect with respect to the presence of the metal plugs.

The higher tension, high hardness and increased mass at the impact zone renders a high level of golf ball direction control and increased kinetic energy transfer to the golf ball, thereby immediately improving a player's golf game.

Accordingly, it is an object of the present invention to provide a golf club head having a face plate that is in tension and has increased hardness and extra mass at the impact zone.

This, and additional objects, advantages, features and benefits of the present invention will become apparent from the following specification.

BRIEF DESCRIPTION OF THE DRAWINGS

FIG. 1 is a perspective view of a golf club equipped with a face plate according to the present invention.

FIG. 2 is a partly sectional view of golf club head having a face plate according to the present invention.

FIG. 3 is a perspective, partly broken-away view of the golf club head of FIG. 2.

DETAILED DESCRIPTION OF THE PREFERRED EMBODIMENT

Figure 4A:
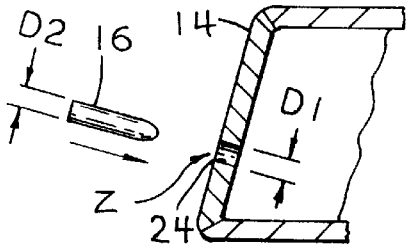
FIGS. 4A and 4B show progressive stages of a press fit fabrication process according to the present invention.

Referring now to the Drawing, FIG. 1 shows a golf club 10 having a metallic "wood" club head 12, wherein the f ace plate 14 thereof is provided with a plurality of hardened metal inserts 16 which are tensionally interfitted therewith. The metal inserts 16 each have a face 18 which is flush with the face plate surface 20, and each metal insert is located in the impact zone Z (shown by dashed lines at FIG. 1) for striking a golf ball 22 with the golf club 10, as best seen at FIG. 2.

The preferred metal plug 16 is composed preferably tungsten carbide or another similarly hard and dense metal. The metal plugs are preferably cylindrically shaped, and have a preferred diameter D2 on the order of the face plate groove width, ie., about 2.5 millimeters to about 3.5 millimeters, and having a length of about 10 millimeters to about 30 millimeters.

Figure 4B:
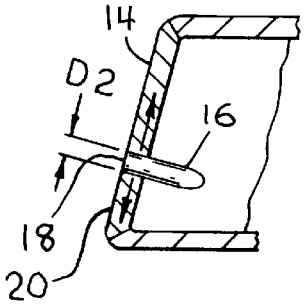

According to a first preferred method of fabrication, which involves a press fit methodology shown at FIGS. 4A and 4B, the face plate 14 is drilled to provide a hole 24 for each metal plug 16, wherein each hole is at a predetermined location of the impact zone Z, and wherein each hole has a diameter D1 less than the diameter D2 of the metal plugs by about 0.02 millimeters to about 0.03 millimeters. Each metal plug 16 is oriented normal to the face plate and then press fit into its respective hole 24, whereupon each metal plug causes the face plate 14 to become tensioned owing to the fact that the hole 24 is now forced to increase in diameter from D1 to D2, as shown at FIGS. 4A and 4B. As can be discerned at FIG. 4B, the exposed face 18 of each metal plug is aligned flush with the adjacent surface 20 of the face plate 14. An alternative method of fabrication is to insert cast the metal plugs with the face plate.

Figure 5A:
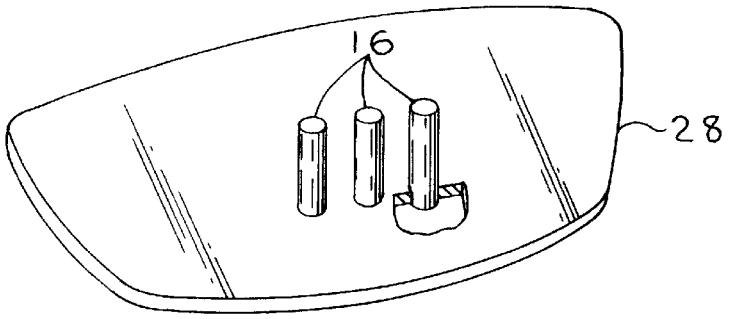
FIGS. 5A through 5C depict stages of an investment casting fabrication process according to the present invention.
Figure 5B:
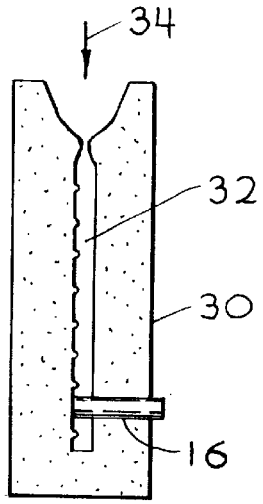
Figure 5C:
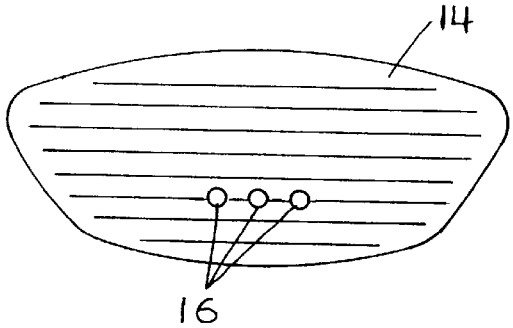

According to a second preferred method of fabrication, which involves investment casting as shown at FIGS. 5A through 5C, the face plate is cast with the metal plugs present. A sacrificial pattern 28, typically of wax, is formed from a pattern mold. The sacrificial pattern 28 includes placement of the metal plugs 16 therein as it will be in the to be formed face plate. A mold 30 is formed around the sacrificial pattern 28, and the sacrificial pattern is, usually, then removed via a heating step, forming a cavity 32. A selected liquid metal alloy 34 is then poured into the cavity of the the mold, filling the space left by the sacrificial pattern. Upon solidification of the alloy, shrinkage stress forms about the metal plugs, with the same tensioning effect as the press fit method of fabrication.

Figure 6A:
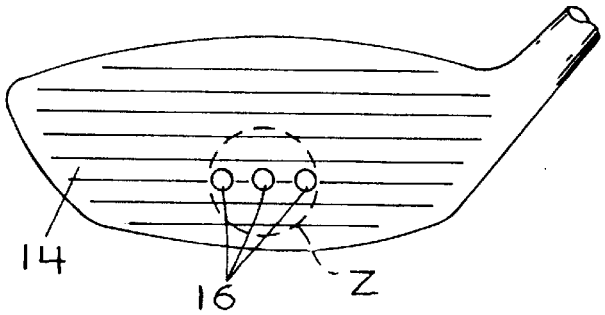
FIGS. 6A through 6C depict side views of face plates having various preferred patterns of the metal plugs according to the present invention.
Figure 6B:
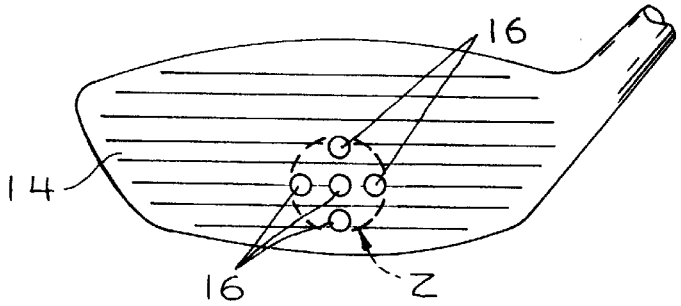
Figure 6C:
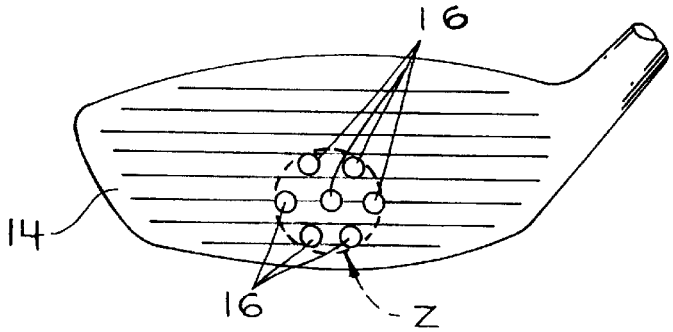

FIGS. 6A through 6C depict several preferred patterns for the metal plugs 16. In FIG. 6A three metal plugs 16 are arranged in a row parallel with the grooves 26 of the face plate 14. In FIG. 6B four metal plugs 16 are arranged in cross pattern having parallel and perpendicular aspects with respect to the grooves 26 of the face plate 14. In FIG. 6C six metal plugs 16 are arranged in a circular pattern, with one metal plug 16 at the center of the circular pattern. In each case, the metal plugs 16 are located generally at the impact zone Z.

Figure 7:
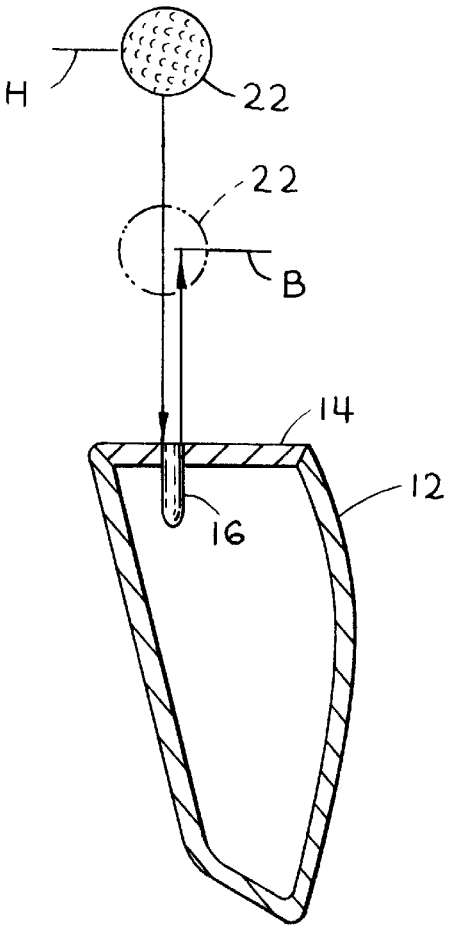
FIG. 7 is a schematic representation of a test to determine golf ball interaction with a face plate according to the present invention.

Turning now to FIGS. 7 though 8D, an experimental test to determine the efficacy of the present invention will now be described.

Figure 8A:
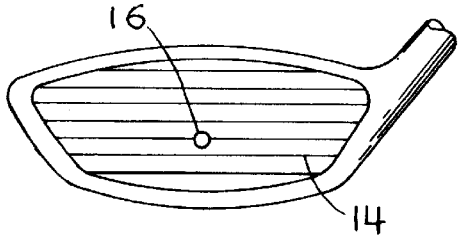
FIGS. 8A through 8D depict various metal plug patterns which were tested according to the schematic representation of FIG. 7.
Figure 8B:
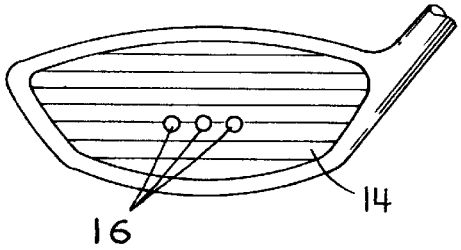
Figure 8C:
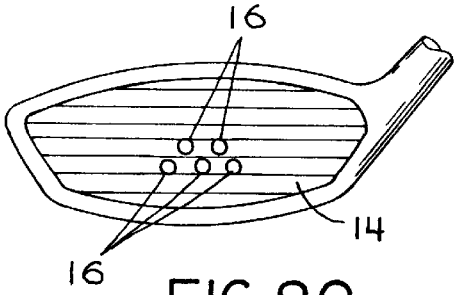
Figure 8D:
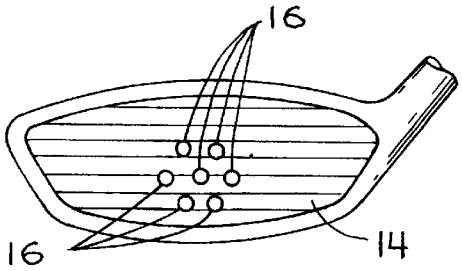

Bounce tests were conducted, as shown schematically at FIG. 7, by dropping a golf ball 22 onto a horizontally oriented face plate 14 of a metallic "wood" club head 12 from a height H of 1 meter and then observing the bounce height B of the golf ball for each of the metal plug patterns shown at FIGS. 8A through 8D. For a face plate unmodified, having no hole and no metal plug, the bounce height B was observed to be 26.0 cm. For a single metal plug 16 arranged as shown at FIG. 8A, the bounce height B was observed to be 27.8 cm. For three metal plugs 16 arranged as shown at FIG. 8B, the bounce height B was observed to be 29.4 cm. For five metal plugs 16 arranged as shown at FIG. 8C, the bounce height B was observed to be 26.6 cm. And finally, for seven metal plugs 16 arranged as shown at FIG. 8D, the bounce height B was observed to be 25.7 cm.

Since the pattern of metal plugs 16 of FIG. 8B had the best result, further tests were conducted, wherein a second metallic "wood" head was tested. For a face plate unmodified, having no hole and no metal plug, the bounce height B was observed to be 32.0 cm. For three metal plugs 16 arranged as shown at FIG. 8B, the bounce height B was observed to be 39.4 cm.

Subjective tests in the field were conducted wherein golf balls were driven, which observationally confirmed the above tests; further, subjective observation of the golf ball trajectory, indicated improved directional control over what would be expected from a conventional golf club head.

It is to be understood that while the metal plugs 16 are shown and described herein with respect to metallic "woods", the metal plugs may be used with "irons" and "putters".

Since it is believed that the golf ball trajectory distance and and directional control are proportional to the hardness and the stress intensity of the face plate, the placement of one or more metal plugs as described hereinabove will enhance these factors and thereby improve performance of a golf club so equipped.

To those skilled in the art to which this invention appertains, the above described preferred embodiment may be subject to change or modification. Such change or modification can be carried out without departing from the scope of the invention, which is intended to be limited only by the scope of the appended claims.

What is claimed is:

1. A method for providing a tensioned, locally hardened and weighted face plate comprising the steps of:

forming a sacrificial pattern identical in shape to a desired face plate, having disposed therein at least one hardened metal plug having a face at a predetermined impact zone of the face plate;

providing a mold from the sacrificial pattern; and casting a molten alloy into the mold to thereby form the desired face plate having the face of the at least one hardened metal plug flush with an outer surface of the desired face plate;

wherein the face plate is locally hardened and tensioned by the presence of at least one hardened metal plug as the alloy solidifies.

2. The method of claim 1, wherein said step of forming uses at least one high density, hardened metal plug having a diameter of between about 2.5 millimeters and about 3.5 millimeters and a length of between about 10 millimeters and about 30 millimeters.

3. A golf club head face plate made according to the method of claim 1.

* * * * *